US006546565B2

(12) United States Patent
Chiang

(10) Patent No.: US 6,546,565 B2
(45) Date of Patent: Apr. 15, 2003

(54) SWIMMING GOGGLES WITH STEP-LESS ADJUSTMENT

(76) Inventor: Herman Chiang, 11F-2, No 634—9 Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/798,841

(22) Filed: Mar. 1, 2001

(65) Prior Publication Data

US 2001/0034896 A1 Nov. 1, 2001

Related U.S. Application Data

(63) Continuation-in-part of application No. 09/541,223, filed on Apr. 2, 2000, now Pat. No. 6,349,417.

(51) Int. Cl.[7] ..... A61F 9/02
(52) U.S. Cl. ..... 2/428; 2/445
(58) Field of Search ..... 2/426, 428, 430, 2/442, 445, 446, 456; 351/43, 155, 156

(56) References Cited

U.S. PATENT DOCUMENTS 5,857,221 A * 1/1999 Geneve et al. ..... 2/428
6,119,277 A * 9/2000 Chiang ..... 2/428
6,247,187 B1 * 6/2001 Chiang ..... 2/428

* cited by examiner

*Primary Examiner*—John J. Calvert
*Assistant Examiner*—Katherine Moran
(74) *Attorney, Agent, or Firm*—Troxell Law Office PLLC

(57) ABSTRACT

A type of swimming goggles comprises: two lens frame units, each of lens frame units accommodates a lens, and at its two opposite ends are a first joining unit and a second joining unit, said first joining unit being located closely to the inner side of said lens frame, including two through holes, and said second joining unit being located on the outside of said lens frame, including two engaging holes with clasp opening thereon, and each of two lens frames having a clasp piece extended along an upper rim and a lower rims of each lens frame to form fixing grooves, two strings passing through said first and second joining units of said two lens frames; wherein the diameter of each of said strings is less than the diameter of each of said through holes and engaging holes, so that would enable said strings to more easily enter said through holes and engaging holes for easier adjustment.

2 Claims, 5 Drawing Sheets

SWIMMING GOGGLES WITH STEP-LESS ADJUSTMENT

CROSS REFERENCE OF RELATED APPLICATION

This application is a continuation-in-part application of the application Ser. No. 09/541,223 filed on Apr. 3, 2000, now U.S. Pat. No. 6,349,417.

BACKGROUND OF THE INVENTION

Field of the invention

FIG. 1 shows the structural feature of the swimming goggles of U.S. Pat. No. 6,349,417 wherein the lens frames 500, 510 of the swimming goggles have clasp openings 501, 511, on two sides thereof, and the clasp pieces 502, 512 on upper and lower rims thereof, respectively. The clasp openings 501, 511 and the clasp pieces 502, 512 define space therein to receive two strings 60, 61. A nose bridge is formed between two frames 500, 510 by the strings 60, 61. There are two ways to adjust the dimension of the nose bridge formed by the two strings 60, 61. One is to separate the strings 60, 61 from the clasp openings 501, 511, and successively adjust the dimension of the nose bridge and finally re-install the strings 60, 61 into the clasp openings 501, 511. The other is to separate the strings 60, 61 from the clasp pieces 502, 512, and successively adjust the dimension of the nose bridge and finally re-install the strings 60, 61 into the clasp pieces 502, 512. Thus, the lens frames 500, 510 can be adjusted with different spans to match the user's face, and the user may feel more comfortable to wear the goggles.

However, one drawback of the aforementioned parent application design is that the diameter of the clasp openings 501, 511 is 2 mm while the diameter of the strings 60, 61 is also 2 mm, and this tight engagement therebetween will make it inconvenient for the user to adjust the nose bridge. Another drawback is the strings 60, 61 is tightly clipped by the clasp pieces 502, 512, and thus it is difficult to separate the strings 60, 61 from the clasp pieces 502, 512.

BRIEF DESCRIPTION OF THE INVENTION

The primary objective of the subject invention is to improve the inner side of the lens frame so as to have the string adapted to move smoothly through the clasp piece. Thus, it is easy to adjust the span while the span will not be affected once adjusted.

The subject a pair of swimming goggles with step-less adjustment includes a pair of lens frames having first and second joining units at two opposite ends of each lens frame. The first joining unit located on the inner side of the lens frame, has two through holes, and the second joining unit located on the outer side of the lens frame has two engaging holes each with a clasp opening communicatively aside. The diameter of the through hole corresponds to the diameter of the engaging hole. The strings connect the pair of lens frame. The diameter of the string is smaller than those of the through hole and the engaging hole. The end of the string could smoothly passes through the through hole of the first joining unit, and the end portion of the string is successively received in the engaging hole via the clasp opening. When the user would like to adjust the distance of the nose bridge, he may only separate the end of the string from the clasp opening, adjust by moving the string to obtain a proper distance to meet the required nose bridge, and finally re-install the end portion of the string into the engaging hole.

DETAILED DESCRIPTION OF PREFERRED EMBODIMENT

Figure 1:
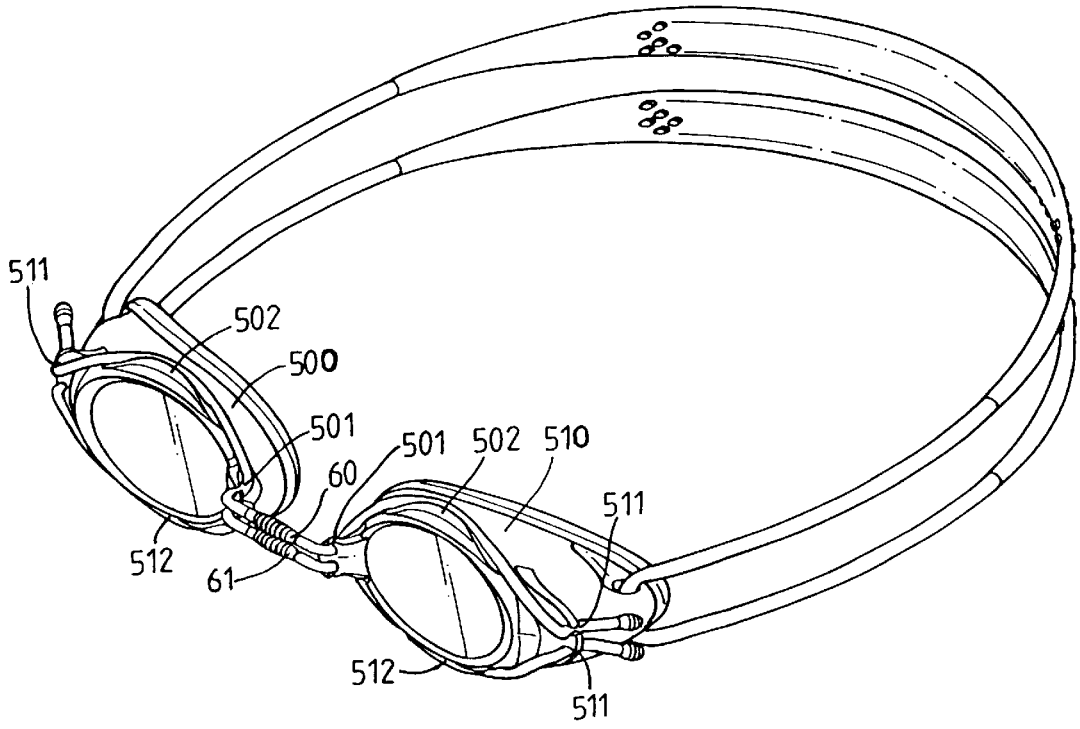
FIG.1 PRIOR ART
FIG. 1 is a perspective view the earlier swimming goggles with step-less adjustment disclosed in the U.S. Pat. No. 6,349,417.
Figure 2:
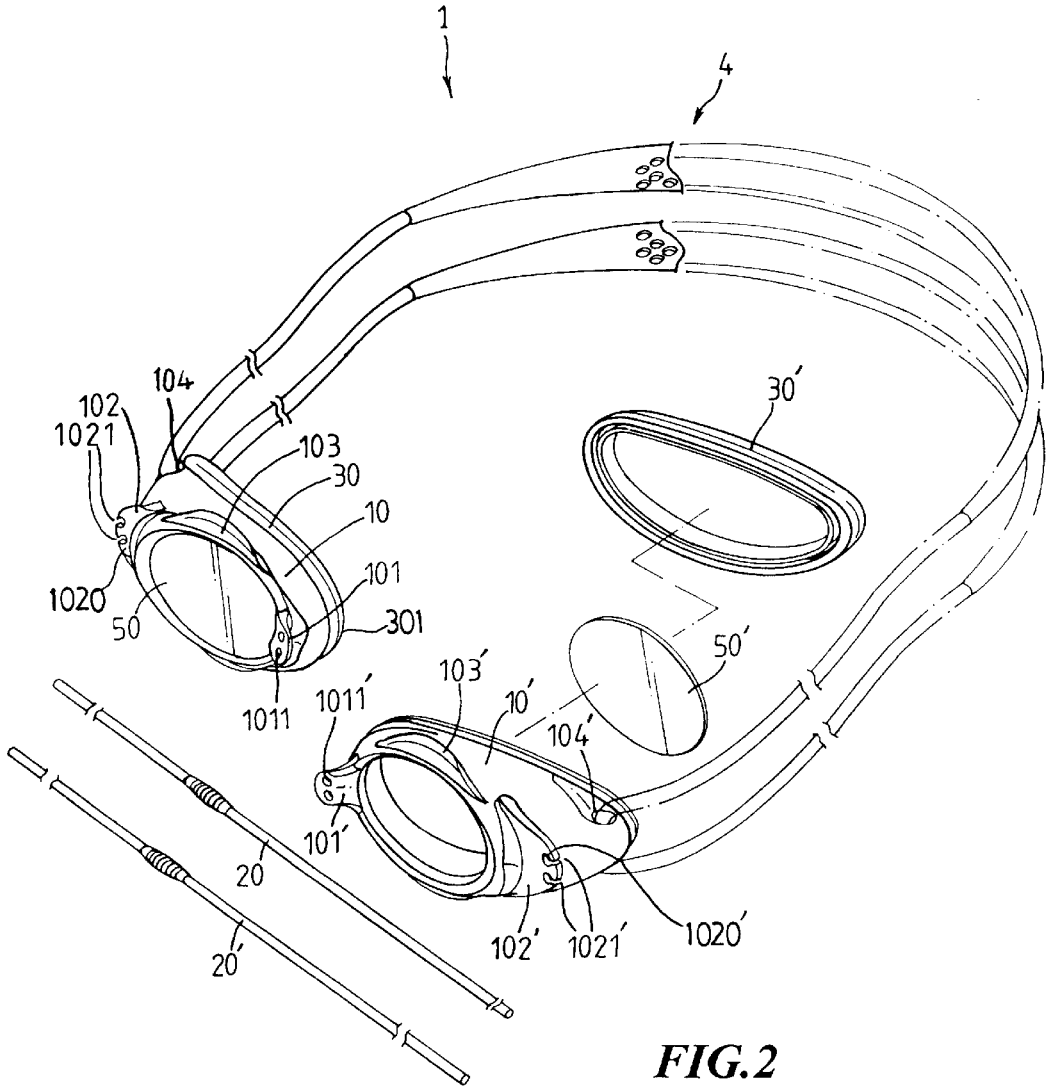
FIG. 2 is a perspective view of the exploded view of the swimming goggles with step-less adjustment of the invention.

As shown in FIG. 2, the pair of swimming goggles 1 includes two lens frame units 10, 10', two strings 20, 20', two protective pads 30, 30', and a headband device 4. The two lens frame units 10, 10' are side by side positioned to receive two lenses 50, 50' therein, respectively The two lens 50, 50' are fixedly implanted in the lens frame units 10, 10', respectively. Two first joining units 101, 101' are respectively positioned on the inner sides of the two lens frame units 10, 10', and two second joining units 102, 102' are respectively positioned on the outer sides of the two lens frame units 10,10'. The first joining units 101,101' have the through holes 1011, 1011', respectively, wherein the diameter of the through hole is 2 mm. The second joining units 102, 102' have the engaging holes 1020, 1020', respectively, wherein the diameter of the through hole is 2 mm. The engaging holes 1020, 1020' further include the clasp openings 1021, 1021' aside to clasp the free ends of the corresponding strings 20, 20' described later. Two clasp pieces 103, 103' are located on upper and lower rims of the lens frame unit 10, 10' to grasp the strings 20, 20' described later. Two through holes 104, 104' are located around the second joining units 102, 102' to receive the strings 20, 20' described later.

The strings 20, 20' are made of flexible material. The diameter of the strings 20, 20' is 1.9 mm which is smaller than that of the through holes 1011, 1011' of the first joining units 101, 101', and also smaller than that of the engaging holes 1020, 1020'. Thus, the strings 20, 20' may smoothly pass through the corresponding through holes 1011, 1011' and the engaging holes 1020, 1020'. Therefore, it is more easily to adjust the dimension of the nose bridge by moving the strings 20, 20'. The protective pads 30, 30' are respectively assembled into the lens frame units 10, 10'. The protective pads 30, 30' have face contact parts 301, 301' with flexibility thereof to allow comfortable contact with the user's face.

Figure 3:
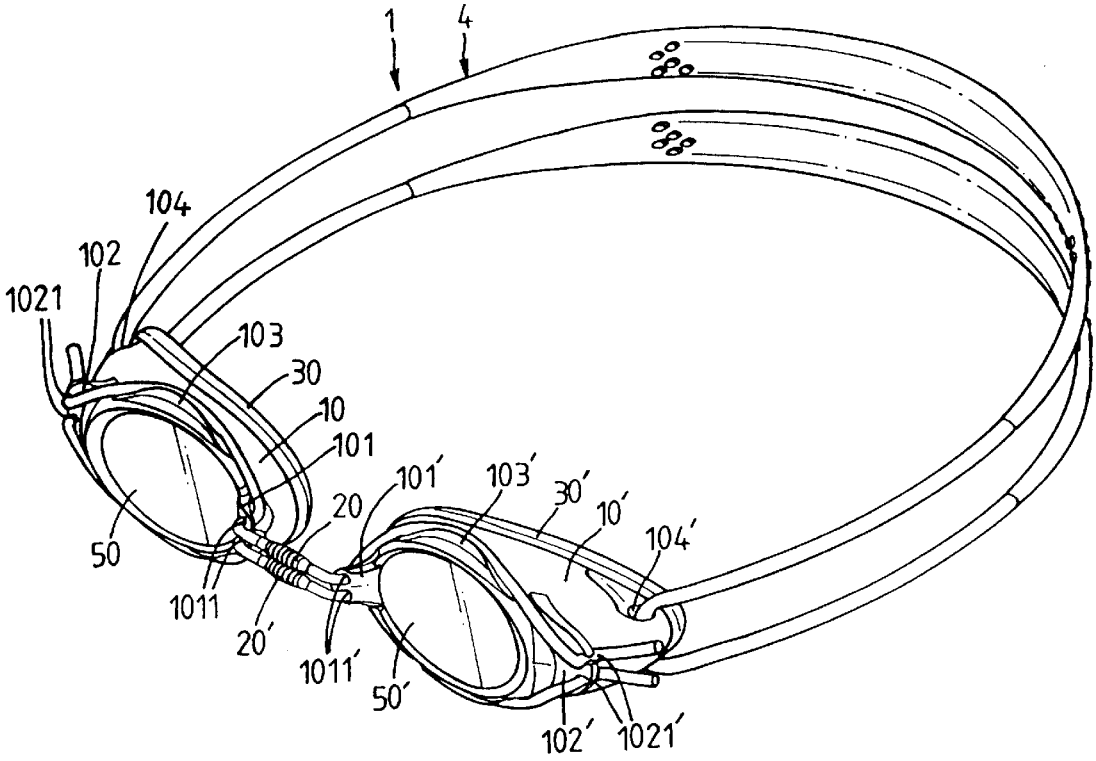
FIG. 3 is a perspective view of the assembled swimming goggles of FIG. 2.
Figure 4:
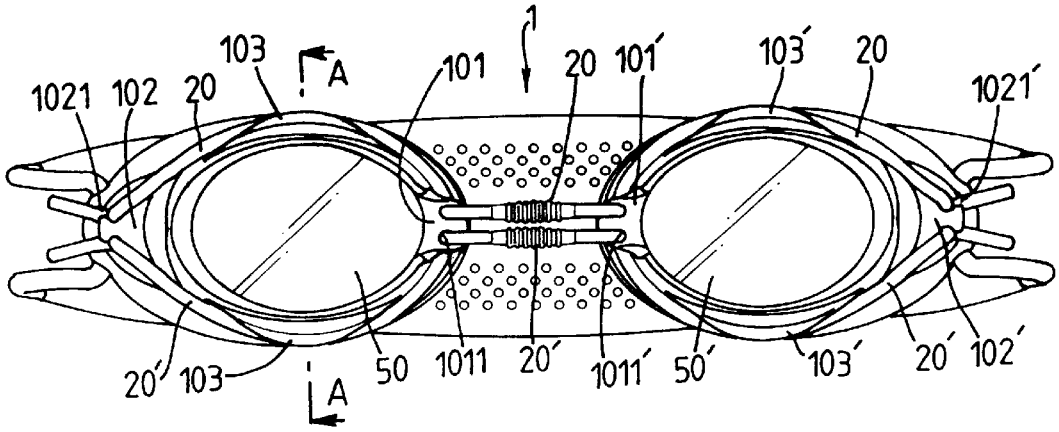
FIG. 4 is a front view of the assembled swimming goggles of FIG. 2.

Please referring to FIGS. 2, 3 and 4, the swimming goggles is assembled via the following steps. The free ends of the two strings 20, 20' pass through the corresponding through holes 1011, 1011' of the first joining units 101, 101', and pass through the corresponding engaging holes 1021, 1021' with portions of the strings 20, 20' being inlayed in the clasp pieces 103, 103'. The two lens frame units 10, 10' are joined as one by means of the two strings 20, 20' with a appropriate distance therebetween and two ends of the strings 20, 20 exposed outside the lens frame units 10, 10'.

Figure 5:
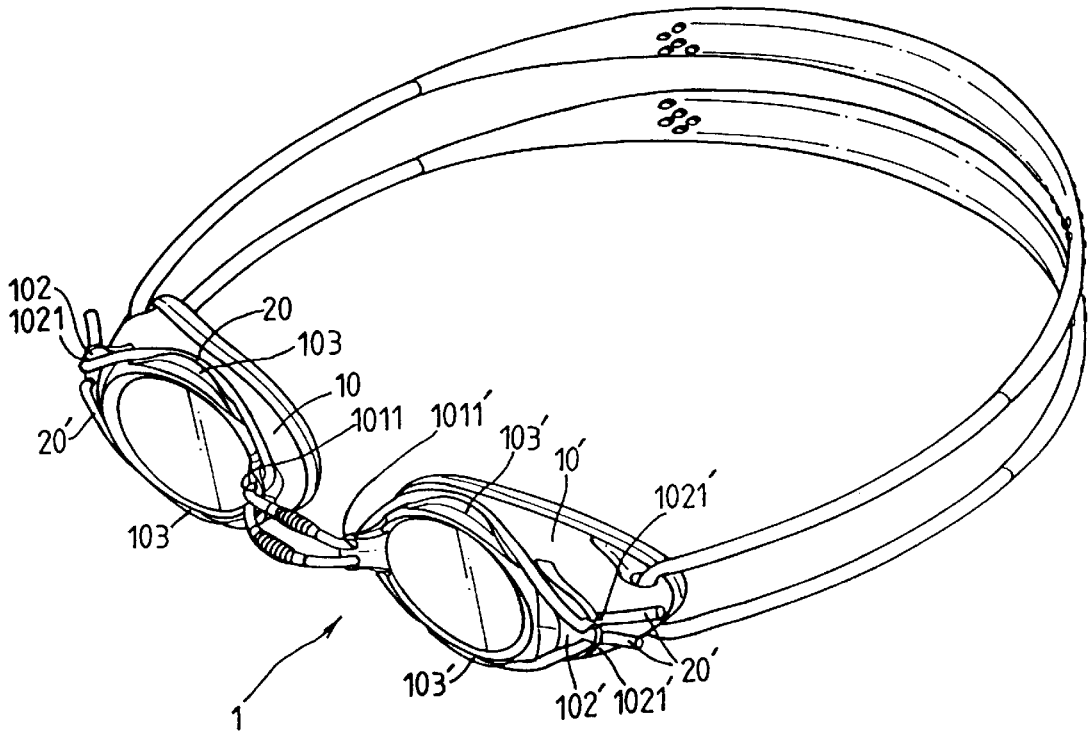
FIG. 5 is a perspective view of the swimming goggles with the different dimensioned nose bridge.

As shown in FIG. 5, during adjusting the dimension of the nose bridge, one of the ends of the strings 20, 20' are separated from one of the second joint units via the corresponding clasp opening and the strings further are removed from the corresponding clasp piece to adjust the dimension of the nose bridge in a step-less manner for complying with the user's face. It is because the diameter of the strings 20, 20' is smaller than that of the through holes, thus the strings 20, 20' being able to smoothly pulled through the through holes 1011, 1011'.

Having proved that the subject invention is capable of achieving the anticipated objective, as described above, it has met the qualification for a patent right. However, the above description has covered merely the preferred embodiment of the subject invention. It is declared herewith that all equivalent modifications and/or variations deriving from the above shall be included in the spirit of the subject claims.

What is claimed is:

1. A type of swimming goggles with step-less adjustment comprising:

two lens frames that each receive a lens, each of said lens frames including a first joining unit located at an inside edge of said corresponding lens frame, and a second joining unit located on an outside edge of said corresponding lens frame, and each of said two lens frames having a clasp piece extending along an upper rim and a lower rim of each lens frame to form fixing grooves, a first string passing through said second joining unit of one of said lens frames, along the upper rim of said one of said lens frames and being secured in said corresponding clasp piece, through said first joining units, along the upper rim of the other of said lens frames and being secured in said corresponding clasp piece, and through said second joining unit of said other of said lens frames so as to maintain a desired separation distance between said two lens frames, said first string extending past said lens frames so that ends of said first string are exposed, a second string passing through said second joining unit of said one of said lens frames, along the lower rim of said one of said lens frames and being secured in said clasp piece, through said first joining units, along the lower rim of said other of said lens frames and being secured in said corresponding clasp piece, and through said second joining unit of said other of said lens frames so as to maintain a desired separation distance between said two lens frames, said each string extending past said lens frames so that ends of said second string are exposed, and a headband device joined to said second joining units, said headband device comprising at least a headband; wherein each said first joining unit includes two through holes, and each said second joining unit includes two engaging holes with clasp openings; and wherein each string has a diameter less than the diameters of the through holes and the engaging holes to facilitate easier adjustment of the strings.

2. A type of swimming goggles with step-less adjustment comprising:

two lens frames each receiving a lens, each of said lens frames including a first joining unit located at an inside edge of said lens frame, and a second joining unit located on an outside edge of said lens frame, and each of two lens frames having a clasp piece extending along an upper rim and a lower rim of each lens frame to form fixing grooves, at least one string, said string passing through said first and second joining units of said two lens frames and being secured in said clasp pieces of said two lens frames so as to maintain a desired separation distance between said two lens frames, said string extending past said lens frames so that ends of said string are exposed, and a headband device joined to said second joining units, said headband device comprising at least a headband; wherein each said first joining unit includes two through holes, and each said second joining unit including two engaging holes with clasp openings; and wherein said at least one string has a diameter less than the diameters of the through holes and the engaging holes to facilitate easier adjustment of said at least one the string.

* * * * *